US005923297A

United States Patent [19]

Kim et al.

[11] Patent Number: 5,923,297

[45] Date of Patent: Jul. 13, 1999

[54] RETRACTABLE ANTENNA SYSTEM WITH SWITCHABLE IMPEDANCE MATCHING

[75] Inventors: Seung Kil Kim, Chapel Hill; Gerard James Hayes, Wake Forest, both of N.C.

[73] Assignee: Ericsson Inc., Research Triangle Park, N.C.

[21] Appl. No.: 09/073,585

[22] Filed: May 6, 1998

[51] Int. Cl.[6] ..... H01Q 1/24

[52] U.S. Cl. ..... 343/702; 343/901; 343/876

[58] Field of Search ..... 343/702, 901, 343/876

[56] References Cited

U.S. PATENT DOCUMENTS 5,335,368 8/1994 Tamura ..... 455/90
5,374,937 12/1994 Tsunekawa et al. ..... 343/702
5,635,943 6/1997 Grunwell ..... 343/702
5,659,888 8/1997 Kato et al. ..... 455/575
5,815,820 9/1998 Kiem et al. ..... 455/575

*Primary Examiner*—Don Wong
*Assistant Examiner*—Jennifer H Malos
*Attorney, Agent, or Firm*—Myers Bigel Sibley & Sajovec, P.A.

[57] ABSTRACT

Antenna systems for radiotelephones and other electronic devices include a first impedance matching circuit that electrically connects to a retractable antenna via a feed terminal when the retractable antenna is in an extended position and a second impedance matching circuit that electrically connects to the retractable antenna via the same feed terminal when the retractable antenna is in a retracted position. A switch opens and closes in response to detected positions of a retractable antenna to allow the first and second impedance matching circuits to electrically connect with an antenna via the same feed terminal.

20 Claims, 3 Drawing Sheets

RETRACTABLE ANTENNA SYSTEM WITH SWITCHABLE IMPEDANCE MATCHING

FIELD OF THE INVENTION

The present invention relates generally to radiotelephones, and, more particularly, to retractable antenna systems for use with radiotelephones.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Many radiotelephones, particularly handheld radiotelephones, employ retractable antennas which may be extended out of, and retracted back into, a radiotelephone housing. Typically, retractable antennas are electrically connected to a printed circuit board containing radio frequency circuitry located within a radiotelephone housing. A radiotelephone antenna is typically interconnected with the radio frequency circuitry such that impedance of the antenna and the radio frequency circuitry are substantially matched. Conventionally, an antenna and radio frequency circuitry are matched at about 50 ohms (Ω) impedance.

Unfortunately, matching impedance of a retractable antenna may be difficult because antenna impedance may be dependent on a position of an antenna with respect to both the housing of a radiotelephone and a printed circuit board containing the radio frequency circuitry. As these respective positions change when an antenna is moved between extended and retracted positions, an antenna typically exhibits at least two different impedance states, both of which should be matched to a 50 Ω impedance of a feed terminal from a printed circuit board. Accordingly, with retractable antennas, it is generally desirable to provide an impedance matching system with dual circuits that provide an acceptable impedance match between an antenna and radio frequency circuitry, both when an antenna is retracted, and when an antenna is extended.

Separate feed terminals may be used with impedance matching circuits to electrically connect a respective matching circuit to an antenna element. Unfortunately, multiple feed terminals may add to the complexity of a radiotelephone antenna design. Furthermore, multiple feed terminals may require mechanical parts, such as spring contacts, that may become unreliable over time.

SUMMARY OF THE INVENTION

It is, therefore, an object of the present invention to allow simplified connections of impedance matching circuits to retractable radiotelephone antennas.

It is another object of the present invention to provide retractable radiotelephone antennas with impedance matching systems that can have fewer mechanical parts.

These and other objects of the present invention are provided by antenna systems for radiotelephones and other electronic devices wherein a first impedance matching circuit is electrically connected to a retractable antenna via a feed terminal when the retractable antenna is in an extended position and wherein a second impedance matching circuit is electrically connected to the retractable antenna via the same feed terminal when the retractable antenna is in a retracted position. A switch opens and closes in response to positions of a retractable antenna to allow multiple impedance matching circuits to electrically connect with the antenna via the same feed terminal.

According to an aspect of the present invention, a magnet may be mounted adjacent an end of a retractable antenna element. A magnetic field generated by the magnet may activate a switch when the antenna is in a retracted position to electrically connect a first impedance matching circuit to the antenna. When the antenna is extended, the magnetic field no longer activates the switch. Accordingly, the switch electrically connects a second impedance matching circuit to the antenna.

Radiotelephones and other electronic devices incorporating retractable antenna systems with impedance matching according to the present invention may be advantageous because multiple feed terminals may not be necessary. By utilizing a single feed terminal for multiple impedance matching circuits, antenna design may be simplified. Furthermore, a reduction in mechanical parts which may become unreliable over time is also a benefit of the present invention.

BRIEF DESCRIPTION OF THE DRAWINGS

The accompanying drawings, which are incorporated in and constitute a part of the specification, illustrate an embodiment of the invention and, together with the description, serve to explain principles of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
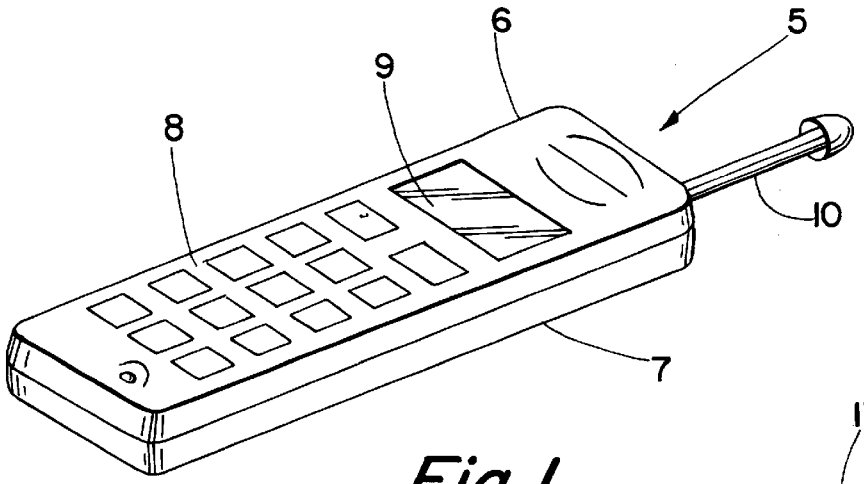
FIG. 1 illustrates an exemplary radiotelephone having a retractable antenna.

Referring now to FIG. 1, a conventional radiotelephone 5 includes a handset unit 6 having a housing 7. The housing 7 encloses a transceiver that enables the radiotelephone 5 to transmit and receive telecommunications signals. A keypad 8, display window 9, and retractable antenna 10 for receiving telecommunications signals, facilitate radiotelephone operation. Other elements of radiotelephones are conventional and need not be described herein.

Figure 2A:
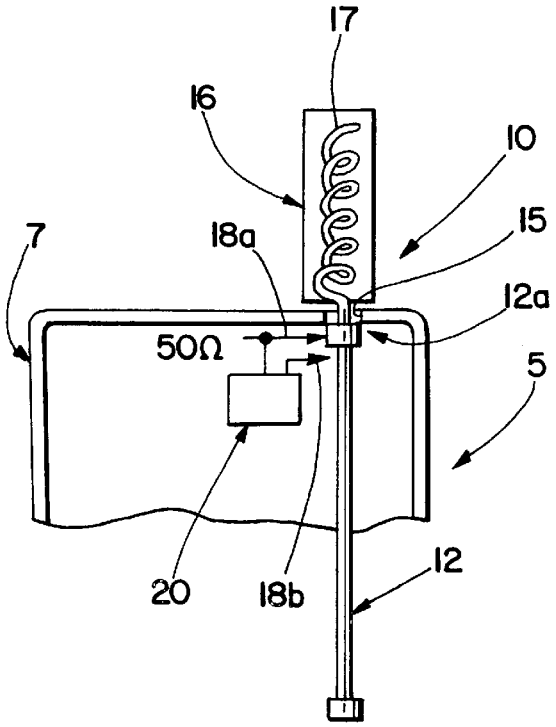
Fig. 2A (PRIOR ART)
FIG. 2A illustrates a conventional radiotelephone retractable antenna and impedance matching system when the antenna is in a retracted position.
Figure 2B:
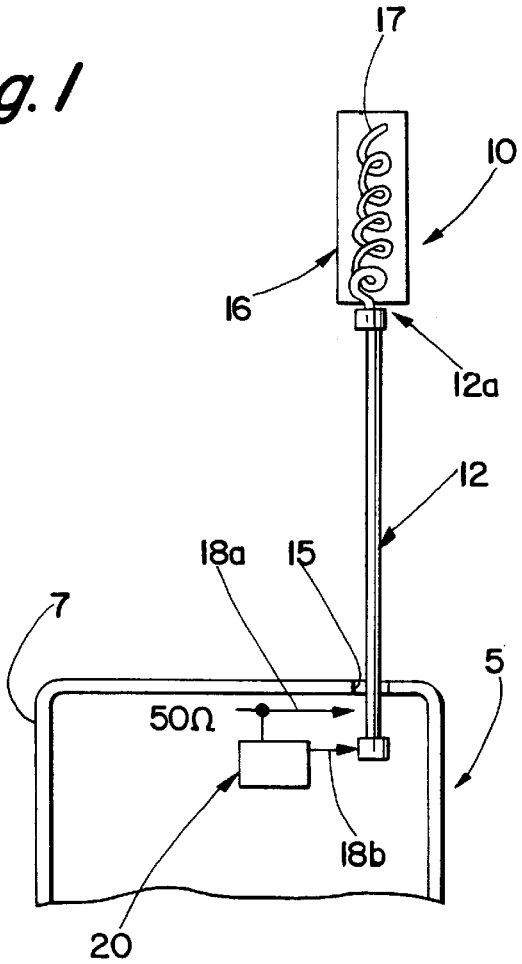
Fig. 2B (PRIOR ART)
FIG. 2B illustrates a conventional radiotelephone retractable antenna and impedance matching system when the antenna is in an extended position.

Referring now to FIGS. 2A and 2B, a conventional retractable antenna 10 for a radiotelephone 5 is schematically illustrated. The illustrated retractable antenna 10 includes a linear rod 12 (or other elongated element) slidably mounted within the radiotelephone housing 7, and movable between a retracted position (FIG. 2A) and an extended position (FIG. 2B) through an aperture 15 in the housing 7. Mounted at an upper end 12*a* of the linear rod 12 is a top load element 16. The illustrated top load element 16 contains a helical coil 17 and has a center axis that coincides essentially with the longitudinal direction of the linear rod 12. One end of the helical coil 17 is free-standing and other end of the helical coil 17 is electrically connected to the linear rod 12.

As is known to those skilled in the art of radiotelephones, an impedance matching system 20 may be provided to match the impedance of the retractable antenna 10 to the impedance (conventionally 50 Ω) of the radio frequency (RF) circuitry (not shown) of the radiotelephone 5. The illustrated impedance matching system 20 employs dual impedance matching circuits. One impedance matching circuit is electrically connected to the linear rod 12 via a feed terminal 18*a* when the linear rod 12 is in a retracted position (FIG. 2A). The other impedance matching circuit is electrically connected to the linear rod 12 via a different feed terminal 18*b* when the linear rod 12 is in an extended position (FIG. 2B). When in a retracted position (FIG. 2A), the antenna 10 conventionally represents a quarter-wave monopole which is matched to 50 Ω through the matching network 20 via feed terminal 18*a*. In an extended position (FIG. 2B), the antenna 10 conventionally represents a half-wave monopole which is matched to 50 Ω through the matching network 20, via feed terminal 18*b*. Impedance matching systems are well known in the art and need not be discussed further.

Figure 3A:
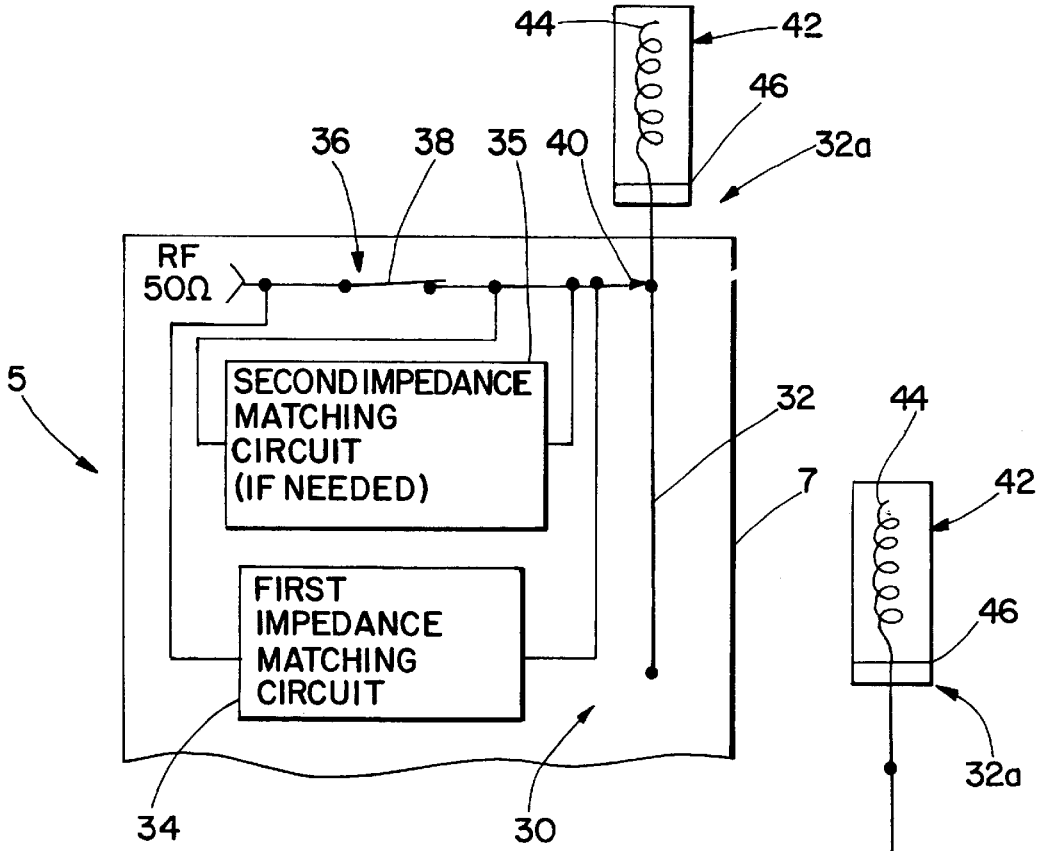
FIG. 3A illustrates a radiotelephone incorporating a retractable antenna system according to the present invention wherein the antenna is in a retracted position.
Figure 3B:
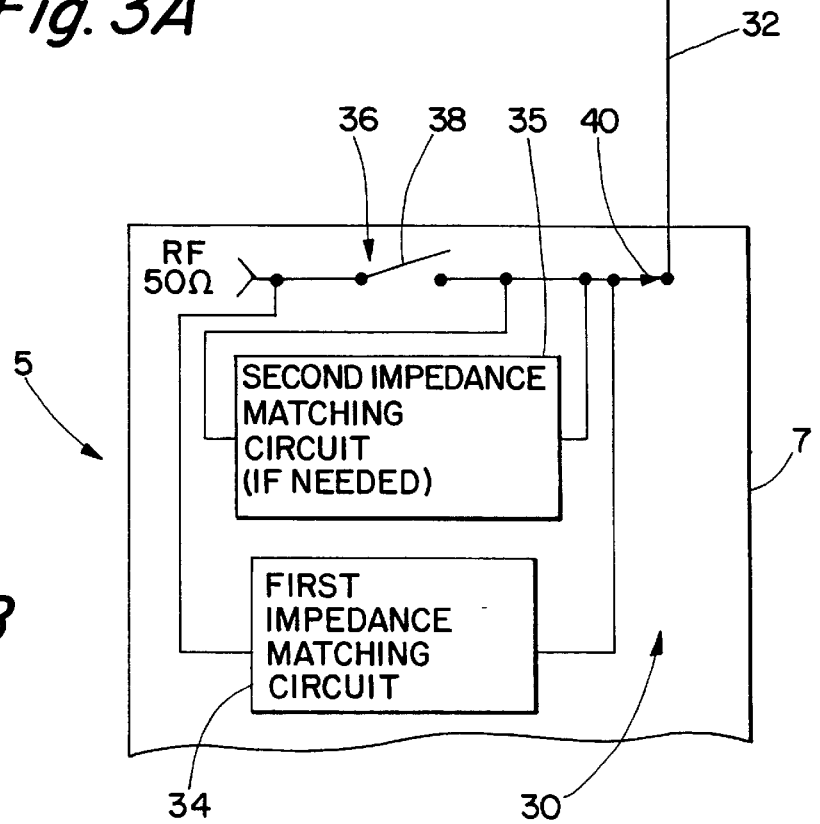
FIG. 3B illustrates a radiotelephone incorporating a retractable antenna system according to the present invention wherein the antenna is in an extended position.

Referring now to FIGS. 3A and 3B, a radiotelephone 5 incorporating a retractable antenna system 30 according to an embodiment of the present invention is schematically illustrated. The illustrated retractable antenna system 30 includes an elongated antenna element 32, a first impedance matching circuit 34, a second impedance matching circuit 35, and a switching circuit 36 which serves as means for electrically connecting the respective first and second impedance matching circuits 34, 35 to the elongated antenna element 32 depending on the position of the elongated antenna element 32. The elongated antenna element 32 is movably mounted within the radiotelephone housing 7 and extendible from the radiotelephone housing 7 so as to have a retracted position (FIG. 3A) and an extended position (FIG. 3B). However, it is understood that the elongated antenna element 32 in accordance with the present invention may be movably mounted to a radiotelephone or other electronic device outside of the housing, as well.

The impedance matching system, disposed within the radiotelephone housing 7, includes first and second impedance matching circuits 34, 35 for matching the impedance of the elongated antenna element 32 to the 50 Ω impedance of the RF circuitry (not shown) of the radiotelephone 5. A switch 38 is provided for electrically connecting (represented schematically by the "open" switch 38) a first impedance matching circuit 34 to the elongated antenna element 32 via a feed terminal 40 when the elongated antenna element 32 is in an extended position (FIG. 3B). Switch 38 also electrically connects (represented schematically by the "closed" switch 38) a second impedance matching circuit 35 to the elongated antenna element 32 via the same feed terminal 40 when the elongated antenna element 32 is in a retracted position (FIG. 3A). The first impedance matching circuit 34 is bypassed when the elongated antenna element 32 is in a retracted position, as would be understood by those skilled in this art.

It is understood that the second impedance matching circuit 35 may not be required. The impedance when the switch 38 is closed may be adequate without requiring a separate impedance matching circuit.

Mounted at an upper end 32*a* of the linear rod 32 is a top load element 42. The illustrated top load element 42 contains a helical coil 44 and has a center axis that coincides essentially with the longitudinal direction of the linear rod 32. One end of the helical coil 44 is free-standing and the other end of the helical coil 44 is electrically connected to the linear rod 32. Mounted within the top load element 42 is a ferrous material which serves as a magnet 46 for generating a magnetic field within the radiotelephone housing 7 when the elongated antenna element 32 is in a retracted position. The present invention is not limited to antennas having the illustrated top load element 42. It is understood that the present invention may be used with any type of retractable antenna that produces different impedances when extended or retracted.

In the illustrated embodiment, the switch 38 is activated by a magnetic field generated by the magnet 46. The switch 38 is configured to close when the elongated antenna element 32 is in a retracted position (FIG. 3A) because the magnet 46 is within close proximity to the switch 38. The switch 38 is configured to open when the elongated antenna element 32 is in an extended position (FIG. 3B) because the magnet 46 is not within close proximity of the switch 38. However, the present invention is not limited to the illustrated embodiment. The switch 38 may be configured to open when the elongated antenna element 32 is in a retracted position and the switch 38 may be configured to close when the elongated antenna element 32 is in an extended position.

The switching circuit 36 may be configured such that the first impedance matching circuit 34 is electrically connected to the elongated antenna element 32 via the feed terminal 40 when the switch 38 is subjected to a magnetic field. Alternatively, the switching circuit 36 may be configured such that the second impedance matching circuit 35 is electrically connected to the elongated antenna element 32 via the feed terminal 40 when the switch 38 is subjected to a magnetic field. In addition, a magnet or other means for generating a magnetic field so as to activate the switch 38, is not limited to the location illustrated in FIGS. 3A and 3B. A magnet may be located along the elongated antenna element in various locations, without departing from the spirit and intent of the present invention.

Figure 4A:
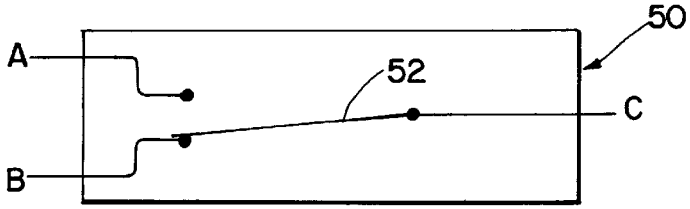
FIGS. 4A–4B schematically illustrate a magnetic reed switch that may be utilized in accordance with the present invention.
Figure 4B:
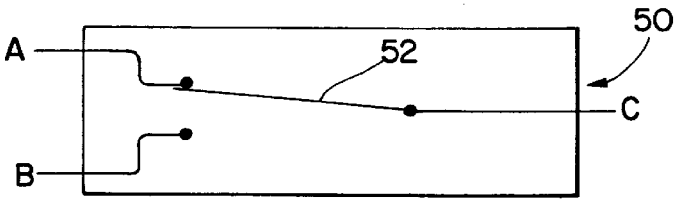

A preferred switching mechanism for use in accordance with the present invention is a magnetic reed switch 50, illustrated in FIGS. 4A and 4B. Magnetic reed switches are well understood by those skilled in the art and will be discussed only briefly herein. In FIG. 4A, a magnetic field is not present. Accordingly, the path from B to C is closed via gate 52, and the path from A to C is open. In FIG. 4B, a magnetic field is present. Accordingly, the path from B to C is open, and the path from A to C is closed via gate 52.

The present invention is not limited to the use of magnets and magnetic fields as means for determining the extended and retracted positions of the elongated antenna element 32.

Switch 38 may be activated to open or close by various other methods known to those skilled in the art.

Figure 5A:
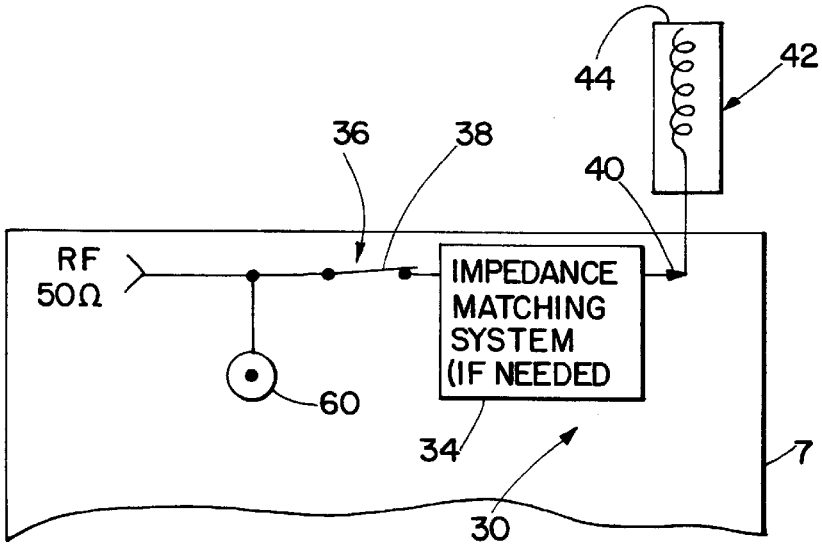
FIGS. 5A–5B illustrate a radiotelephone incorporating a port configured to receive a test probe or accessory according to an embodiment of the present invention.
Figure 5B:
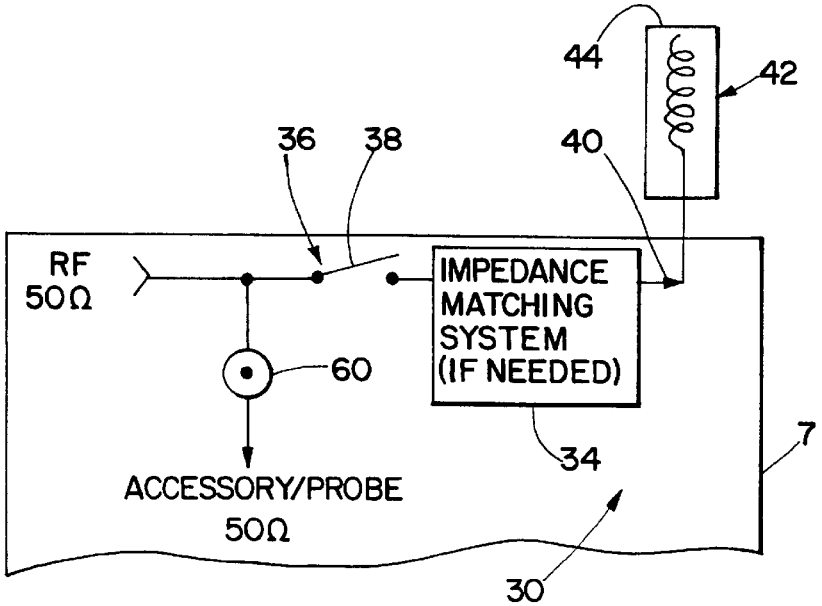

According to another aspect of the present invention illustrated in FIGS. 5A and 5B, a test instrument or accessory may be configured to activate the switch 38 such that an impedance matching circuit is electrically connected to the test instrument or accessory. For example, a factory test probe could be connected to a port 60 in the radiotelephone 5 and cause switch 38 to provide a 50 Ω impedance. In FIG. 5A, a test probe or accessory is not connected to the port 60. Accordingly, the port 60 is open and the impedance of the port does not impact the RF signal. In FIG. 5B, a test probe or accessory is connected to the port 60. A magnetic field caused by the test probe or accessory causes the switch 38 to open, thereby removing the antenna system 30 from the circuit. The RF signal is directed to the test probe or accessory connected to the port 60 with a 50 Ω impedance.

An exemplary accessory is a vehicle cradle into which the radiotelephone 5 can be removably secured. A jack in the car cradle can be provided with a magnet such that when inserted into the accessory port, the switch 38 is activated so that an impedance matching circuit is electrically connected to an antenna system of the car cradle.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna system for an electronic device, said antenna system comprising:

an antenna element movably mounted to said electronic device and extendible from said electronic device so as to have an extended position and a retracted position;

a magnet adjacent an end of the antenna element that extends from the housing in both the extended and retracted positions;

an impedance matching system disposed within said electronic device, said impedance matching system comprising first and second impedance matching circuits; and means for electrically connecting said first impedance matching circuit to said antenna element via a feed terminal when said antenna element is in said extended position and for electrically connecting said second impedance matching circuit to said antenna element via said feed terminal when said antenna element is in said retracted position, said connecting means comprising:

a magnetically activated switch;

wherein said magnetically activated switch is configured to electrically connect said first impedance matching circuit to said antenna element via said feed terminal when said antenna element is in an extended position such that the switch is not subjected to a magnetic field from the magnet; and wherein said magnetically activated switch is configured to electrically connect said second impedance matching circuit to said antenna element via said feed terminal when said antenna element is in a retracted position such that the switch is subjected to a magnetic field from the magnet.

2. An antenna system according to claim 1 wherein said magnet is positioned within a top load element adjacent an end of said antenna element that extends from said housing in both the extended and retracted positions.

3. An antenna system according to claim 2 wherein said antenna element is a quarter-wave antenna and wherein said top load element is a quarter-wave helical antenna that is electrically connected with said antenna element to form a half-wave antenna when said antenna element is in the extended position.

4. A radiotelephone having a retractable antenna, said radiotelephone comprising:

a radiotelephone housing;

an antenna element movably mounted to said housing and extendible from said housing so as to have an extended position and a retracted position;

an impedance matching system disposed within said radiotelephone housing, said impedance matching system comprising first and second impedance matching circuits; and means for electrically connecting said first impedance matching circuit to said antenna element via a feed terminal when said antenna element is in said extended position and for electrically connecting said second impedance matching circuit to said antenna element via said feed terminal when said antenna element is in said retracted position;

a port within said radiotelephone housing; and means for electrically connecting said first impedance matching circuit to a device connected to said port.

5. A radiotelephone according to claim 4 wherein said means for electrically connecting said first and second impedance matching circuits to said antenna element via said feed terminal comprises means for determining extended and retracted positions of said antenna element.

6. A radiotelephone according to claim 5 wherein said position determining means comprises a switch configured to electrically connect said first impedance matching circuit to said antenna element via said feed terminal when said antenna element is in an extended position and to electrically connect said second impedance matching circuit to said antenna element via said feed terminal when said antenna element is in a retracted position.

7. A radiotelephone according to claim 6 wherein said switch is configured to electrically connect said first impedance matching circuit to said antenna element via said feed terminal when said switch is subjected to a magnetic field.

8. A radiotelephone according to claim 6 wherein said switch is configured to electrically connect said second impedance matching circuit to said antenna element via said feed terminal when said switch is subjected to a magnetic field.

9. A radiotelephone according to claim 8 further comprising means for subjecting said switch to a magnetic field when said antenna element is in a retracted position.

10. A radiotelephone according to claim 9 wherein said means for subjecting said switch to a magnetic field when said antenna element is in a retracted position comprises a magnet positioned on said antenna element.

11. A radiotelephone according to claim 10 wherein said magnet is positioned within a top load element mounted adjacent an end of said antenna element extending from said housing.

12. A radiotelephone according to claim 8 further comprising means for subjecting said switch to a magnetic field when said antenna element is in an extended position.

13. A radiotelephone according to claim 12 wherein said means for subjecting said switch to a magnetic field when said antenna element is in an extended position comprises a magnet positioned on said antenna element.

14. A radiotelephone having a retractable antenna, said radiotelephone comprising:

a radiotelephone housing;

an antenna element movably mounted to said housing and extendible from said housing so as to have an extended position and a retracted position;

an impedance matching system disposed within said radiotelephone housing, said impedance matching system comprising first and second impedance matching circuits;

means for generating a magnetic field within said radiotelephone housing when said antenna element is in said retracted position; and a switch configured to electrically connect said first or second impedance matching circuits to said antenna element when said switch is subjected to a magnetic field by said magnetic field generating means;

a port within said radiotelephone housing;

means for generating a magnetic field within said radiotelephone housing when a device is connected to said port; and means for electrically connecting said first or second impedance matching circuit to said device connected to said port.

15. A radiotelephone according to claim 14 wherein said magnetic field generating means comprises a magnet.

16. A radiotelephone according to claim 15 wherein said magnet is located within a top load element mounted adjacent an end of said antenna element extending from said housing.

17. A radiotelephone according to claim 14 wherein said first and second impedance matching circuits are electrically connected to said antenna element via a single feed terminal.

18. An antenna system for an electronic device, said antenna system comprising:

an antenna element movably mounted to said electronic device and extendible from said electronic device so as to have an extended position and a retracted position;

a magnet adjacent an end of the antenna element that extends from the housing in both the extended and retracted positions;

an impedance matching system disposed within said electronic device, said impedance matching system comprising an impedance matching circuit;

a magnetically activated switch, wherein said magnetically activated switch is configured to electrically connect said impedance matching circuit to said antenna element when said antenna element is in an extended position such that the switch is not subjected to a magnetic field from the magnet, and wherein said magnetically activated switch is configured to electrically bypass said impedance matching circuit when said antenna element is in a retracted position such that the switch is subjected to a magnetic field from the magnet.

19. An antenna system according to claim 18 wherein said magnet is positioned within a top load element adjacent an end of said antenna element that extends from said housing in both the extended and retracted positions.

20. An antenna system according to claim 19 wherein said antenna element is a quarter-wave antenna and wherein said top load element is a quarter-wave helical antenna that is electrically connected with said antenna element to form a half-wave antenna when said antenna element is in the extended position.

* * * * *